United States Patent [19]

Röck et al.

[11] Patent Number: 4,815,796

[45] Date of Patent: Mar. 28, 1989

[54] DRAWER

[75] Inventors: Erich Röck, Höchst; Helmut Hollenstein, Lustenau; Josef Brunner, Höchst, all of Austria

[73] Assignee: Julius Blum Gesellschaft M.B.H., Höchst, Austria

[21] Appl. No.: 42,352

[22] Filed: Apr. 24, 1987

[30] Foreign Application Priority Data

May 14, 1986 [AT] Austria ..... 1280/86
Feb. 16, 1987 [AT] Austria ..... 318/87
Mar. 27, 1987 [AT] Austria ..... 749/87

[51] Int. Cl.[4] ..... A47B 88/00

[52] U.S. Cl. ..... 312/263; 312/330 R; 403/406.1

[58] Field of Search ..... 312/263, 330; 403/406.1, 407.1, 353

[56] References Cited

U.S. PATENT DOCUMENTS 4,011,706 3/1977 Dupree ..... 403/406.1
4,042,288 8/1977 Litchfield ..... 312/330 R
4,191,439 3/1980 Cohen ..... 312/330 R
4,589,710 5/1986 Rock et al. ..... 312/330 R
4,589,711 5/1986 Plank ..... 312/330 R
4,601,523 7/1986 Wenzlick et al. ..... 312/330 R

FOREIGN PATENT DOCUMENTS 96898 12/1983 European Pat. Off. ..... 312/330 R

*Primary Examiner*—Joseph Falk
*Attorney, Agent, or Firm*—Wenderoth, Lind & Ponack

[57] ABSTRACT

A fitting fastens each side of a drawer front panel to metal drawer sides. In a vertical web adjacent the front panel of each drawer side is provided a recess open towards the front and having vertically projecting therein a nose to hang a holding member of the front panel. A slot, which is stamped out of the drawer side and into which projects a nose of a clamping plate, is disposed behind the recess. The clamping plate can be clamped to a holding plate which is perpendicular to the front panel and which is secured to the front panel. The holding plate and the clamping plate, which together form the holding member, receive therebetween the vertical web of the drawer side.

20 Claims, 10 Drawing Sheets

DRAWER

The invention relates to a fitting for a drawer that can be assembled from a plurality of components and that has metal drawer sides which at the same time form the pull-out rails for extracting the drawer, each drawer side including a horizontal runner flange for a roller mounted on a piece of furniture, a vertical web which forms the side wall of the drawer, and fastening means for a front panel and a rear wall of the drawer.

In addition to drawers which are produced in one piece, in particular drawers of plastics material, drawers are used which are assembled from a plurality of components.

These drawers are generally provided with fittings which are part of the pull-out guide mounting which facilitates the extraction and insertion of the drawer from and into the piece of furniture.

In addition, modern drawers comprise holding means for the front panel which often make it possible to adjust the position of the front panel after assembly, in order to correct the alignment of the drawer relative to the joints and the side of the piece of furniture after the drawer has been inserted into the piece of furniture.

Furthermore, drawers are known which comprise metal drawer sides, i.e. side walls. These drawer sides have the advantage that the pull-out rails of the pull-out guides mounted at the side of the drawer can be formed directly on the drawer side.

SUMMARY OF THE INVENTION

The object of the invention is to provide an apparatus which permits a simple and rapid anchoring of the front panel to metal drawer sides of this type.

A further object of the invention is to provide fittings for a drawer which can be assembled from a plurality of components and in which the essential components, namely the drawer sides, can be left the same, and nevertheless, with different additional fittings, it is made made possible for different types of fastenings for the front panel to be provided, so that, depending upon the price range at which the drawer is to be produced, different possibilities of mounting the front panel and the rear wall are provided.

These objects are achieved according to the invention in that in its vertical web adjacent the front panel each drawer side is provided with a recess open towards the front and having a vertically projecting nose on which a holding member of the front panel can be hung. A clamping apparatus for the holding member is disposed beside the recess. A holding plate, which is perpendicular to the front panel and which is secured to thereto, and a clamping plate together form the holding member and receive therebetween the vertical web of the drawer side between them.

BRIEF DESCRIPTION OF THE DRAWINGS

Various embodiments of the invention are described below with reference to the accompanying drawings, in which.

DETAILED DESCRIPTION OF THE INVENTION

Figure 1:
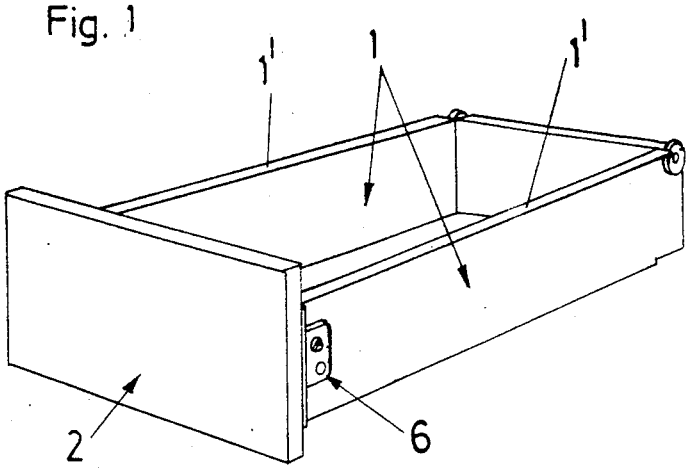
FIG. 1 is a perspective view of a drawer according to the invention.
Figure 2:
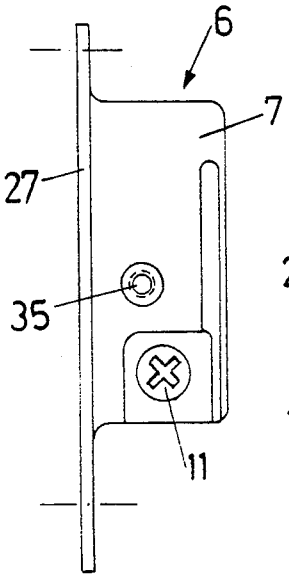
FIG. 2 is a lateral view of a holding plate.
Figure 3:
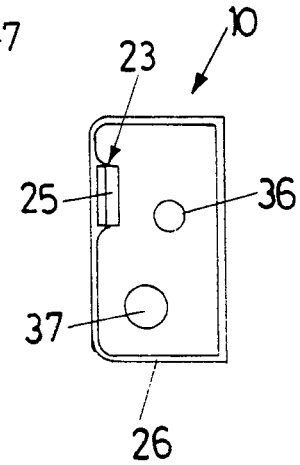
FIG. 3 is a lateral view of a clamping plate.
Figure 4:
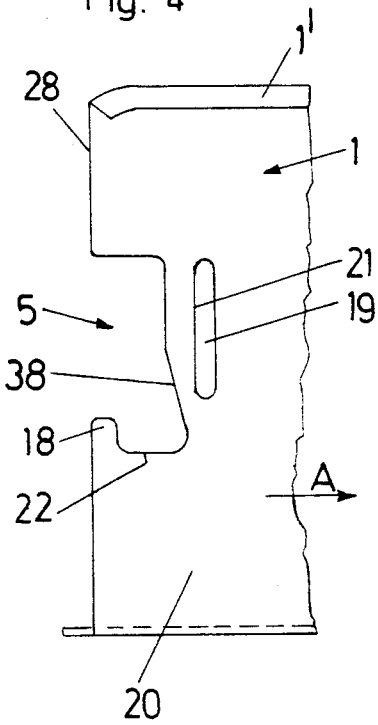
FIG. 4 is a lateral view of the front end of a drawer side.
Figure 5:
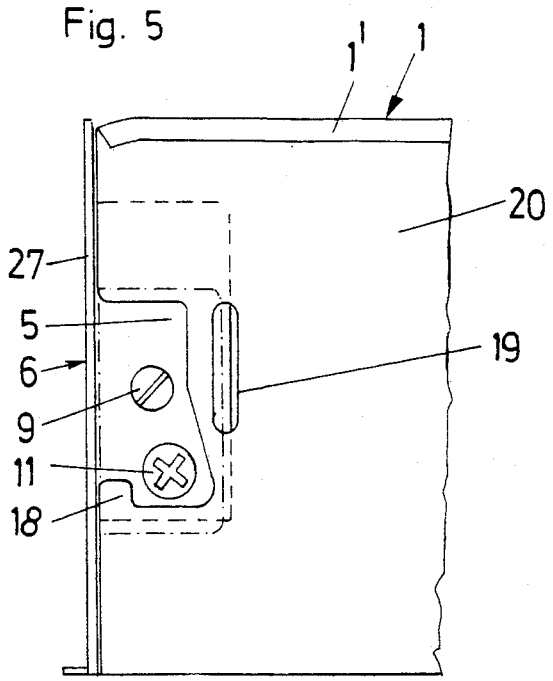
FIGS. 5 and 6 are lateral views of the front end of the drawer side from opposite sides in the case of a holding member hung in the drawer side, either the holding plate or the clamping plate being omitted.
Figure 6:
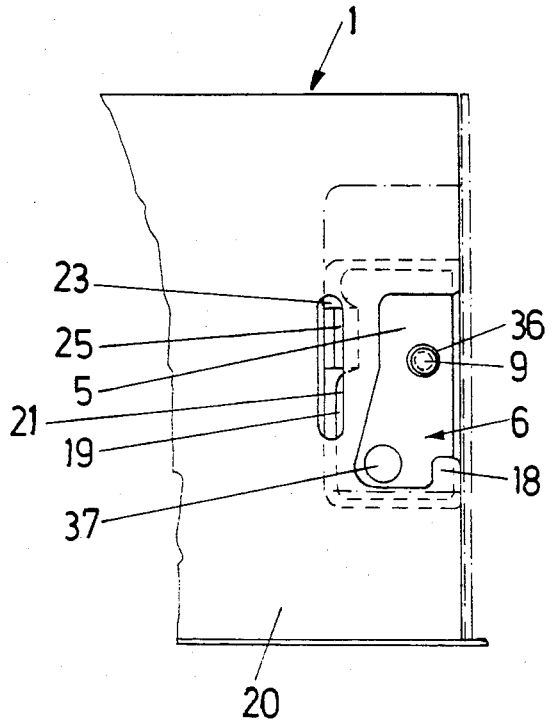
Figure 7:
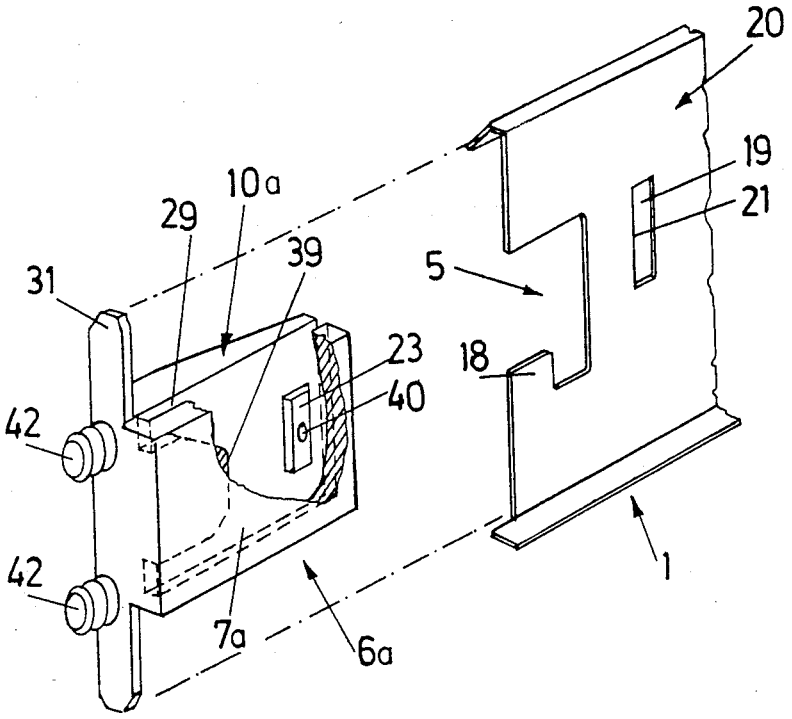
FIG. 7 is a perspective view of a further embodiment of a holding member and of the front end of a drawer side.

The parts of the drawer essential to the invention are drawer sides 1 and front panel 2. The front panel 2 is hung on the drawer sides 1 by means of two holding members 6.

The drawer sides 1 consist of metal and each has a running strip 1' at the top for a roller on the respective side of a piece of furniture. Each drawer side 1 is provided at the rear thereof with a roller.

The base and rear wall of the drawer are joined to the drawer sides 1 in a conventional manner.

Each holding member 6 essentially comprises two parts, namely a holding plate 7 and a clamping plate 10. The holding plate 7 and the clamping plate 10 are joined together in most cases by means of an attachment screw 9.

The holding plate 7 includes a laterally projecting flange 27. By means of which plate 7 it is attached directly to the front panel 2, for example by means of screws.

In addition, the holding plate 7 has a threaded hole 35 for the attachment screw 9 and an eccentric 11. The eccentric 11 is used for adjusting the front panel 2 vertically.

In the embodiment according to FIGS. 2 to 6 the clamping plate 10 is provided with an edge flange 26. A nose 23, which has a wedge surface 25, is formed on this edge flange 26. In addition, an opening 36, through which the attachment screw 9 projects in the assembled state, and an opening 37, which allows access to the eccentric 11, are provided in the clamping plate 10. The eccentric 11 can be turned for example by means of a screwdriver.

The drawer side 1 is provided with a recess 5 open towards the front. A nose 18 projects vertically into the bottom of recess 5 so that the holding plate 7 can be hung by the eccentric 11 on the drawer side 1.

In the embodiment according to FIGS. 2 to 6 a vertical slot 19 is formed behind the recess 5.

During the assembly of the front panel 2 the two holding members 6 are screwed into the front panel 2 on the left and right thereof. In the same way the clamping plates 10 are held on the holding plates 7 by means of the attachment screws 9, in such a way that a vertical web 20 of each drawer side 1 can be inserted between the respective holding plate 7 and clamping plate 10. In this connection the eccentric 11 is hung in the recess 5 behind the nose 18, so that the front panel 2 is quickly supported or hung on the drawer sides 1.

In this position each nose 23 projects into the respective slot 19,. A wedge surface 25 lies on edge 21 of the slot 19.

The eccentric 11 is supported on lower edge 22 of the recess 5.

The height of the front panel 2 can be adjusted by rotating the eccentric 11.

When the front panel 2 is in the desired position, the attachment screw 9 is tightened, as a result of which the clamping plate 10 is pressed forward the holding plate 7. In this connection the nose 23 is pressed further into the slot 19, and due to the wedge surface 25 contacting on the edge 21, the clamping plate 10 and with it the holding plate 7 are pulled in the direction of arrow A in FIG. 4. The flange 27 of each holding plate 7 is pressed onto the front edge 28 of the respective drawer side 1, as a result of which the front panel 2 is securely anchored on the drawer sides 1.

The recess 5 is bounded at the bottom towards the rear by an oblique edge 38, so that the eccentric 11 does not obstruct the tightening of the holding plate 6.

In the embodiment according to FIGS. 7 to 10 the holding member **6*a*, which is injection-moulded from plastics material, comprises a block which is provided with a groove 29 which is surrounding by the holding member 6*a* on three sides. The groove 29 separates the holding plate 7*a* and the clamping plate 10*a***.

Figure 8:
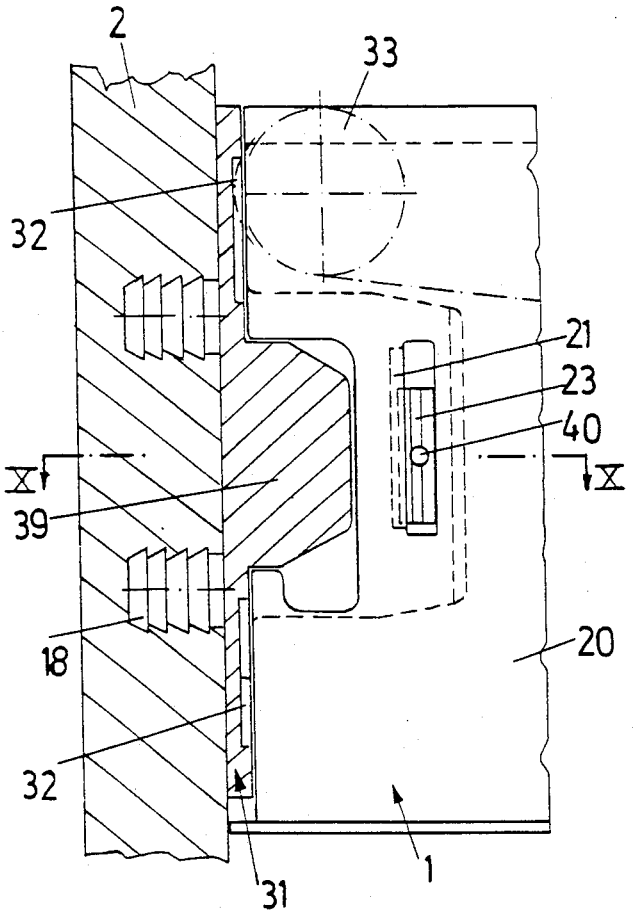
FIG. 8 is a section through a fitting according to the invention shown in the hung state.
Figure 9:
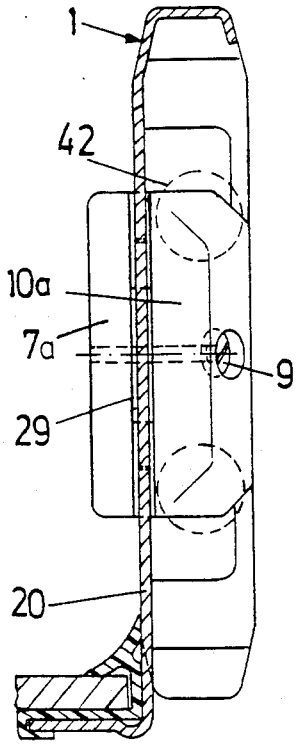
FIG. 9 is a front elevation, partially in section, of a drawer side with a fitting according to the invention, in which the front panel has been omitted for the sake of clarity.
Figure 10:
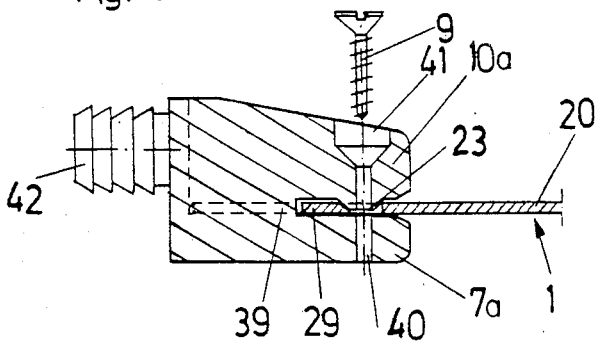
FIG. 10 is a section along the line X—X in FIG. 8.
Figure 11:
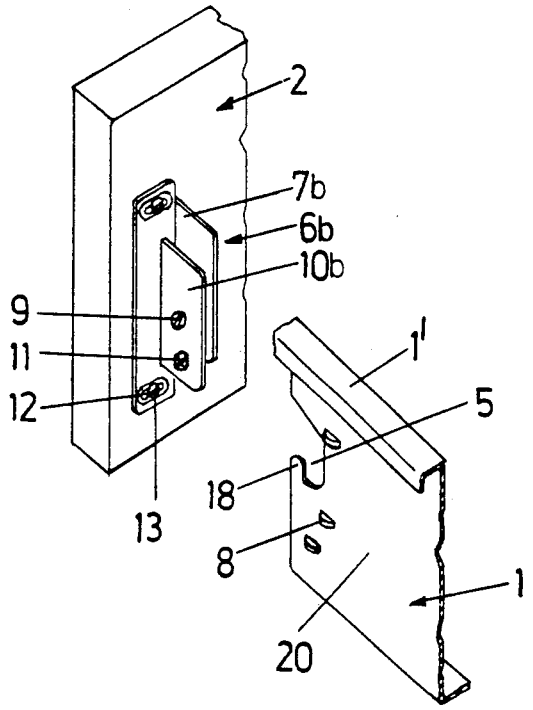
FIG. 11 is a perspective view of a further embodiment of a corner connection between the front panel and the drawer side, in which the parts are shown separated.

A core 39, which is shown most clearly in FIGS. 8 and 10, is formed on the holding member **6*a* and extends into the groove 29**.

The trapezoidal nose 23 is provided on the lateral wall of the groove 29 which is formed by the clamping plate **10*a*. As shown in FIG. 10, the holding member 6*a* is provided in the region of the nose 23 with an opening 40 which extends transversely and the purpose of which is to receive the attachment screw 9**.

On one side of the holding member **6*a* the opening 40 is provided with a reamed section 41 which can receive the head of the attachment screw 9** completely.

The holding member **6*a* is provided with a flange 31 which in the assembled state is positioned between the front panel 2 and the front face of the drawer side 1**.

In addition, the holding member **6*a* is provided with tenons 42 by means of which it is held on the front panel 2**.

In order to assemble the front panel 2, the holding members **6*a* are positioned on the front panel 2**.

It is now sufficient for the front panel 2 with the holding members **6*a* to be pushed onto the drawer sides 1, in such a way that the core 39 of each holding member 6 is preferably fully received in the recess 5 and the holding plate 7*a* and the clamping plate 10*a*, which are separated by the groove 29, embrace opposite sides of the vertical web 20 of the drawer side 1** on both sides.

In this connection the nose 23 snaps into the slot 19, and the front panel 2 is already held on the drawer sides 1.

For finally securing the front panel 2 the attachment screws 9 are screwed into the holding members **6*a* on both sides of the drawer. In this way even strong forces can act upon the front panel 2, without the latter being inadvertently torn from the drawer sides 1**.

The flange 31 is provided at the top and bottom with depressions 32. When the drawer is fully inserted into the piece of furniture the roller 33 on the side of the piece of furniture rests on the bottom of the upper depression 32, so that the front panel does not project excessively from the piece of furniture.

A further variant of the fitting according to the invention for securing the front panel 2 to the drawer sides 1 is described below with reference to FIGS. 11 to 16.

The drawer sides 1 are again provided at their front end with the beak-shaped, angled recesses 5 which are open towards the front. The holding parts **6*b* of the front panel 2 can be hung in these recesses 5**.

The holding parts **6*b* are secured to the front panel 2** in conventional manner, for example they are screwed thereto.

Each holding part **6*b* is provided with an angled flange which forms the holding plate 7*b***.

Each drawer side 1 has stamped-out lugs or brackets 8 which are disposed beside and below the recess 5. In this connection the brackets 8 have at least one oblique face 8'.

Figure 14:
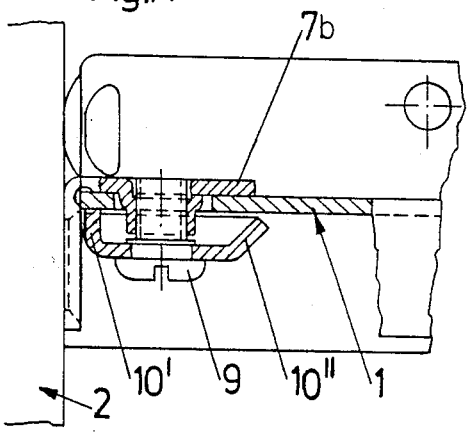
FIG. 14 is a section along the line XIV—XIV in FIG. 12.
Figure 15:
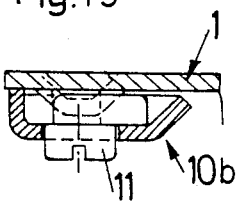
FIG. 15 is a section along the line XV—XV in FIG. 12.
Figure 16:
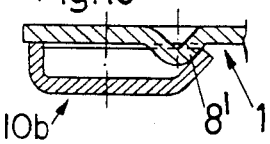
FIG. 16 is a section along the line XVI—XVI in FIG. 12.
Figure 17:
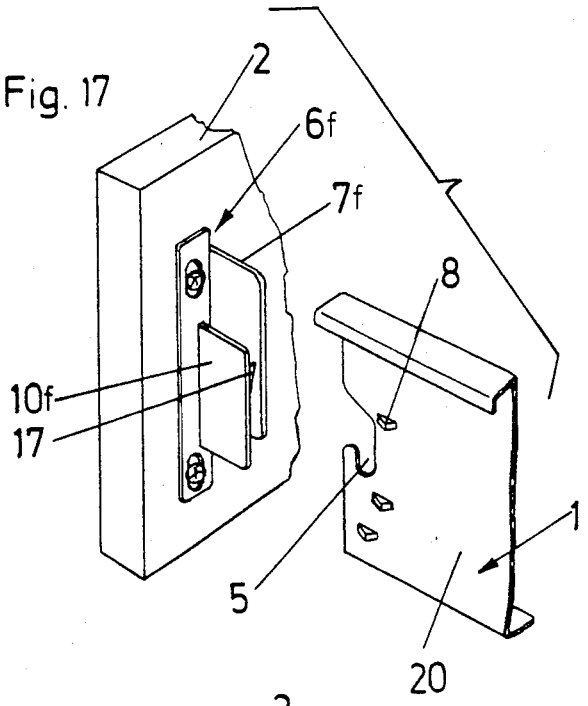
FIG. 17 is a perspective view of a further embodiment of the corner connection between the front panel and the drawer side, in which the parts are shown separated.

One attachment screw 9 is threaded through the holding plates **7*b* of each holding part 6*b*. This attachment screw 9 extends through a clamping plate 10*b* shaped like a cap. The cap-shaped clamping plate 10*b* includes, as shown in FIG. 14 in particular, a flange 10' perpendicular to the drawer side 1 and an oblique flange 10''. The latter flange 10*b*'' is on the side of the clamping plate 10 remote from the front panel 2**.

Figure 12:
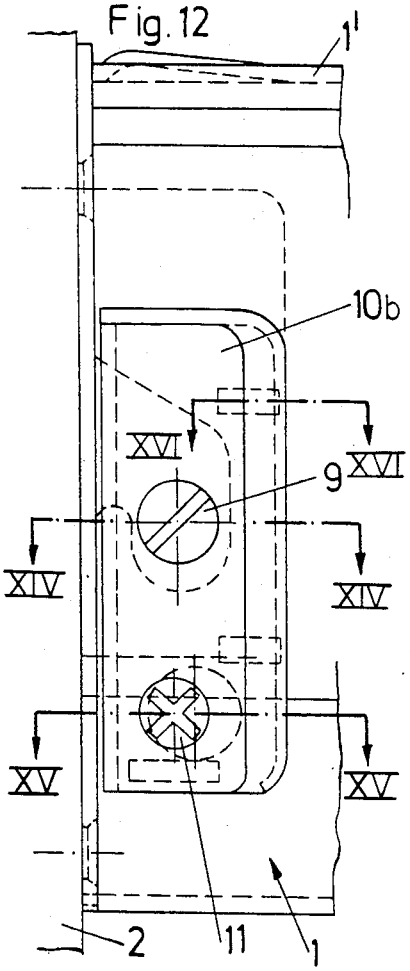
FIG. 12 is a lateral view of the corner connection of the front panel and the drawer side.
Figure 13:
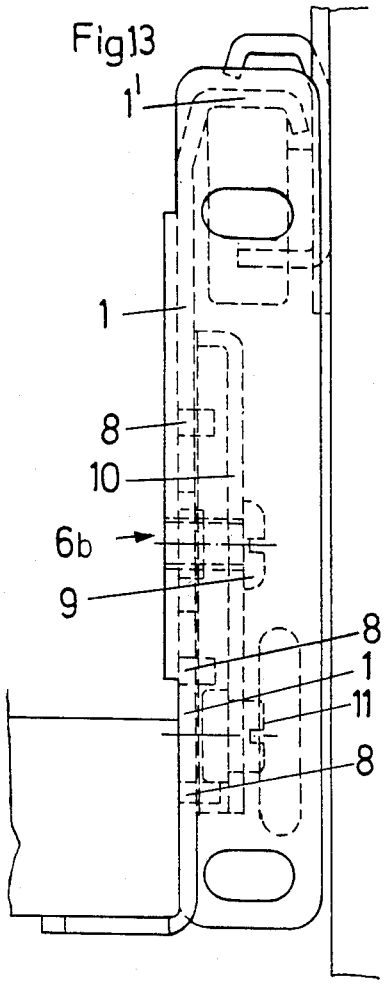
FIG. 13 is a front elevation of the corner connection.

As is evident from FIGS. 12, 13 and 14, the holding parts **6*b* are hung in the drawer sides 1 on such a way that each attachment screw 9 is guided through the recess 5 and the holding plate 7*b* is situated on the inside of the drawer side 1 and the clamping plate 10 is situated on the outside of the drawer side 1**.

In this connection the clamping plate **10*b* rests with its flange 10'' against the oblique faces 8' of two brackets 8. When the attachment screw 9 is tightened, the holding plate 7*b* and thus the holding member 6*b* are pulled towards the drawer side 1 by the wedge action of the oblique faces 10'', 8' and are clamped to the drawer side 1**.

In This embodiment, an eccentric 11 is again mounted at the bottom of the clamping plate 10*b*, and rests on the lowest bracket 8. By rotating the eccentric 11, before the attachment screw 9 is tightened, it is possible to adjust the height of the front panel 2.

If fastening holes 12 for fastening screws 13 for mounting the holding members 6*b* on the front panel 2 are constructed as horizontal longitudinal holes, the front panel 2 can also be adjusted laterally.

Figure 19:
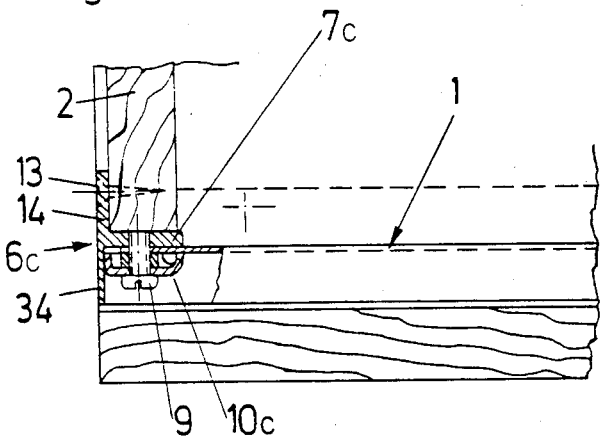
FIG. 19 is a section through a corner connection between the front panel and the drawer side, in which the front panel has been set back.
Figure 20:
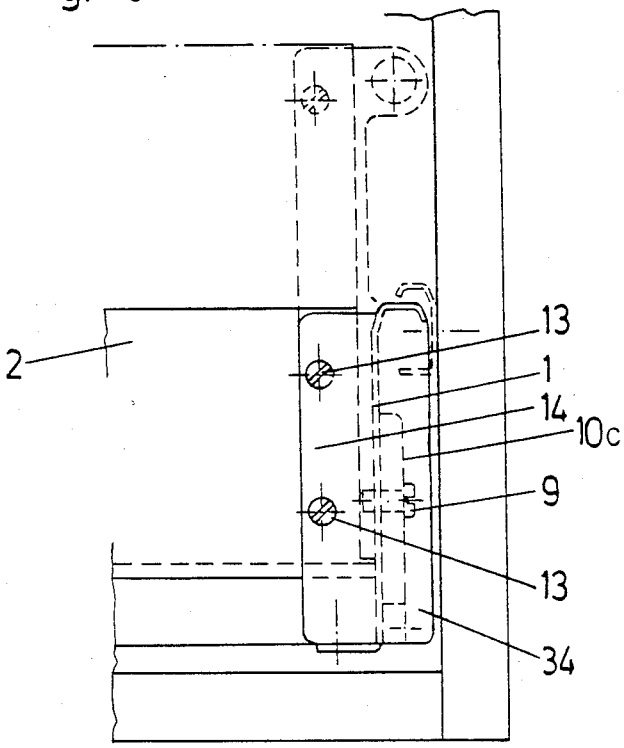
FIG. 20 is a front elevation of such embodiment.
Figure 21:
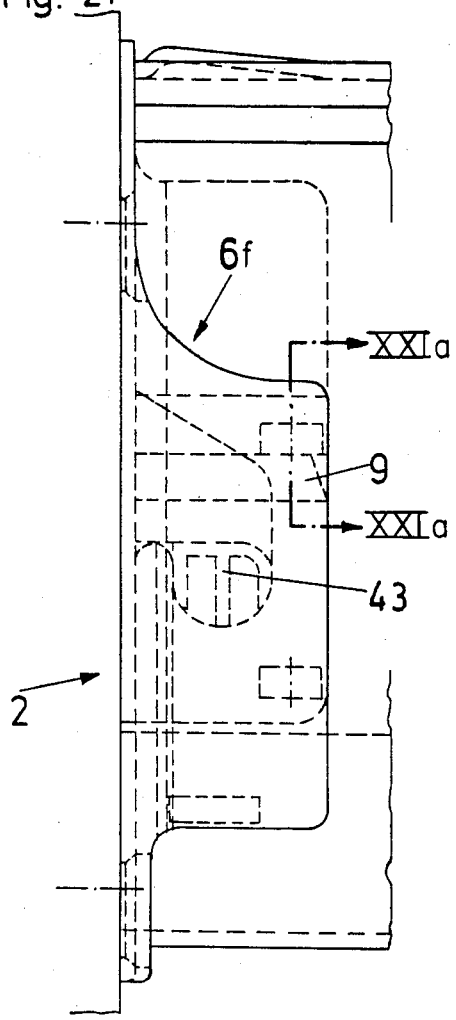
FIG. 21 is a lateral view of the embodiment according to FIG. 17.
Figure 22:
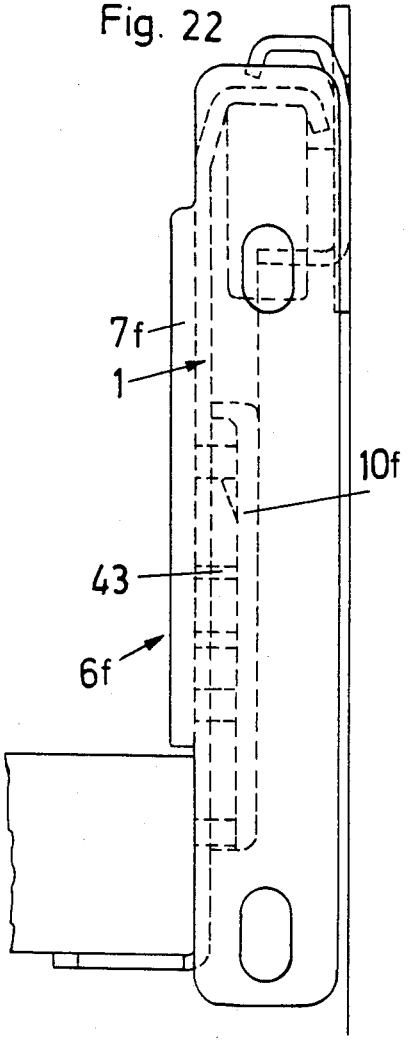
FIG. 22 is a front elevation of such embodiment.
Figure 23:
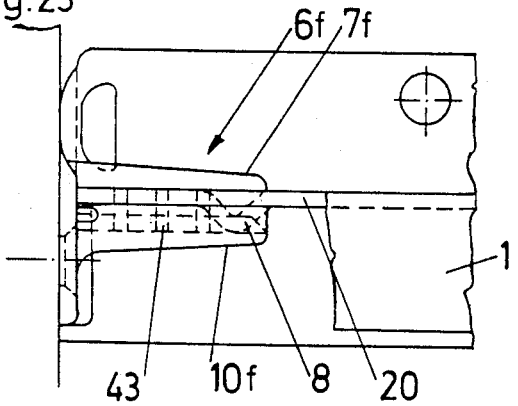
FIG. 23 is a plan view of such embodiment.
Figure 21A:
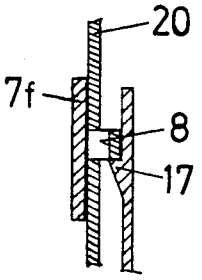
FIG. 21*a* is a section along the line XXIa—XXIa in FIG. 21.
Figure 25:
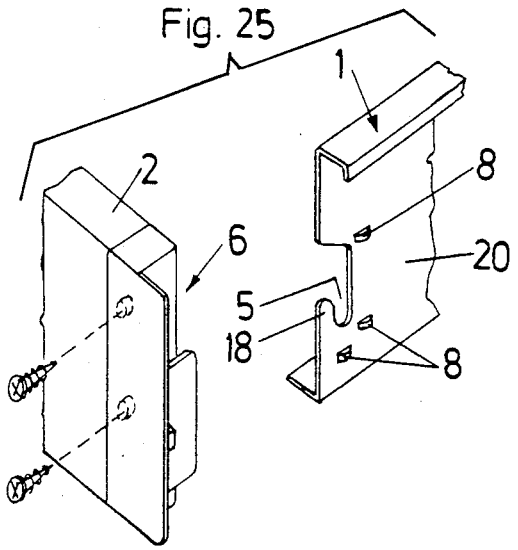
FIGS. 24 to 26 are perspective views of further embodiments of corner connection between the front panel and the drawer side.

FIGS. 19 and 20 show embodiments of a front panel fastening, in which holding members 6*c* are in the form of adaptors. In this connection each holding member 6*c* bears with a flange which forms the holding plate 7*c* on the respective end face of the front panel 2 and has a flange 14 which engages over the front face of front panel 2. A flange 34 on each holding member 6*c* covers the front face of drawer side 1 and the rollers for extracting the drawer.

The attachment screw 9 again is mounted in the holding plate 7*c* and presses holding plate 10*c* brackets 8.

In this embodiment the fastening screws 13 project through the flange 14.

Figure 26:
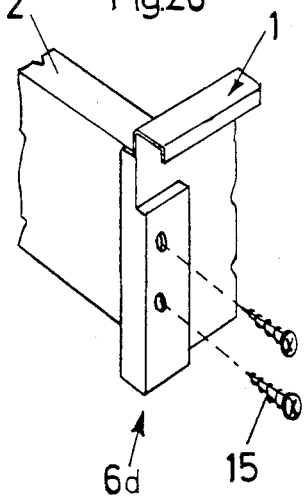

In FIG. 26 is illustrated a particularly simple holding part 6*d* is, which joins the front panel 2 and the drawer side 1 merely by means of screws 15.

Figure 24:
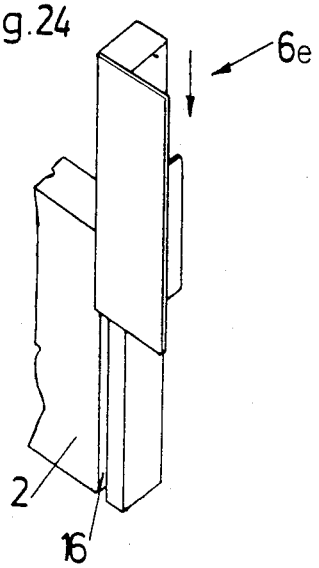

In the embodiment according to FIG. 24 the front panel 2 is provided on the front side with a groove 16, into which is inserted corresponding flange of a holding member 6*e*.

The embodiments described above are suitable in particular for a so-called inner drawer, i.e. in the inserted state the drawer is situated completely inside the piece of furniture and is covered at the front by a conventional hinged door. The front panel 2 should end at the front with the side wall of the piece of furniture.

In the embodiment according to FIGS. 17 and 21 to 23 the holding members 6*f* are provided with a snap-in mechanism. The clamping plate 10*f* carries a catch projection 17*f* opposite the holding plate 7*f*. A hook member 43 is formed between the holding plate 7*f* and the clamping plate 10*f*. In order to assemble the front panel 2 the holding member 6*f* is hung with the hook member 43 in the recess 5 and is pressed so far downwards that the catch projection 17 engages below the upper bracket 8. The front panel 2 is thus securely mounted on the drawer side 1. The holding plate 7*f*, the hook member 43 and the clamping plate 10*f* are advantageously formed in one piece and are injection-moulded from plastics material for example.

Figure 18:
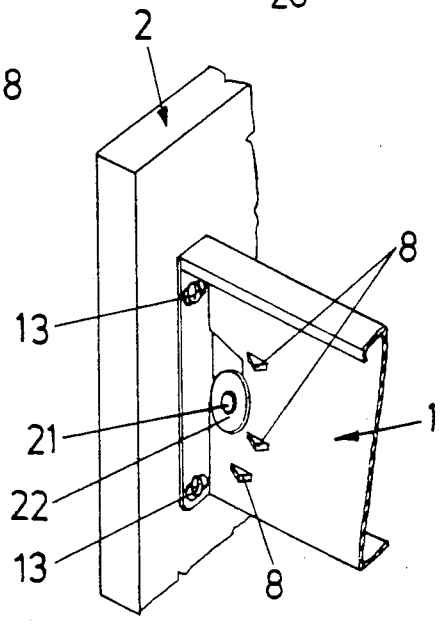
FIG. 18 is a similar view of a further embodiment, the front panel being shown hung on the drawer side.

In the embodiment according to FIG. 18 the holding member is clamped on the drawer side 1 merely by the attachment screw 21 which is provided with a washer 22. This embodiment shows that widely differing possibilities of fastening the front panel 2 are provided with the same drawer side 1.

We claim:

1. A fitting for mounting each of opposite ends of a drawer front panel to a respective metal drawer side in the form of a vertical web, said fitting comprising:

a front end of said vertical web of said metal drawer side having therein a recess open to the front and having a hook shape defined by a nose of said front end of said vertical web projecting upwardly into said recess, said front end of said vertical web having at least one abutment surface;

a holding member to be attached to the respective end of the drawer front panel, said holding member including an integral holding plate extending from said holding member in a direction parallel to said vertical web, and said holding member including means to fit into said recess in said front end of said vertical web with said holding plate extending along a first side of said front end of said vertical web;

a clamping plate extending along a second side of said front end of said vertical web such that said front end of said vertical web is positioned between said holding plate and said clamping plate, said clamping plate having abutment means for engaging said abutment surface of said front end of said vertical web, whereby said means of said holding member fitting into said recess and said abutment means engaging said abutment surface provide an initial mounting of said holding member and thus the drawer front panel of said drawer side; and tightening means, operably associated with said mounting plate and said clamping plate, for urging said clamping plate toward said mounting plate and thereby for clamping therebetween said front end of said vertical web in a final mounted position.

2. A fitting as claimed in claim 1, wherein said front end of said vertical web has therethrough an opening including an edge defining said abutment surface, and said clamping plate has a projection extending into said opening and having a wedge surface defining said abutment means.

3. A fitting as claimed in claim 2, wherein said opening is slot-shaped, and said projection is elongated.

4. A fitting as claimed in claim 3, wherein said projection has a trapezoidal configuration.

5. A fitting as claimed in claim 2, wherein said opening is position rearwardly of said recess.

6. A fitting as claimed in claim 1, wherein said front end of said vertical web has extending therefrom at least one lug defining said abutment surface, and said clamping plate includes an inclined flange defining said abutment means.

7. A fitting as claimed in claim 6, wherein said front end of said vertical web includes plural said lugs positioned both rearwardly of and below said recess.

8. A fitting as claimed in claim 7, wherein said clamping plate has mounted thereon an eccentric in abutment with a said lug positioned below said recess, thereby forming means for vertically adjusting the position of said clamping plate relative to said drawer side.

9. A fitting as claimed in claim 1, wherein said front end of said vertical web has extending therefrom a lug defining said abutment surface, and said clamping plate has extending therefrom a catch projection defining said abutment means.

10. A fitting as claimed in claim 1, wherein said clamping plate includes a first flange extending perpendicular to said vertical web and a second flange inclined relative thereto.

11. A fitting as claimed in claim 1, wherein said tightening means comprises a screw extending through said clamping plate and threaded into said holding plate.

12. A fitting as claimed in claim 11, wherein said screw comprises said means of said holding member fitting into said recess.

13. A fitting as claimed in claim 1, wherein said holding member, said holding plate and said clamping plate are formed integrally as a single element.

14. A fitting as claimed in claim 13, wherein said single element is formed of a resilient plastic material.

15. A fitting as claimed in claim 1, wherein said holding plate extends in a direction to abut a respective end face of the drawer front panel and said holding member includes a flange to extend along the front face of the drawer front panel.

16. A fitting as claimed in claim 15, wherein said holding member includes a further flange extending in a direction to cover said clamping plate and said front end of said drawer side.

17. A fitting as claimed in claim 1, wherein said holding member includes a vertically extending rib for fitting into a groove in the drawer front panel.

18. A fitting as claimed in claim 1, wherein said means of said holding member fitting into said recess comprises an eccentric mounted on said holding plate and abutting a bottom surface of said recess, thereby enabling vertical adjustment of the position of said holding member relative to said drawer side.

19. A fitting as claimed in claim 1, wherein said holding member includes a laterally projecting flange abutting the front edge of said drawer side.

20. A fitting as claimed in claim 19, wherein said laterally projecting flange has therein a depression into which is to fit a roller of an article of furniture into which is installed the drawer.

* * * * *